US011219275B2

(12) United States Patent
Kawano

(10) Patent No.: US 11,219,275 B2
(45) Date of Patent: Jan. 11, 2022

(54) ARTICLE INCLUDING A CORD WINDING DEVICE

(71) Applicant: ALPEN CO., LTD., Nagoya (JP)

(72) Inventor: Fumiyoshi Kawano, Nagoya (JP)

(73) Assignee: ALPEN CO., LTD., Nagoya (JP)

( * ) Notice: Subject to any disclaimer, the term of this patent is extended or adjusted under 35 U.S.C. 154(b) by 168 days.

(21) Appl. No.: 16/482,217

(22) PCT Filed: Jan. 26, 2018

(86) PCT No.: PCT/JP2018/002378
§ 371 (c)(1),
(2) Date: Jul. 30, 2019

(87) PCT Pub. No.: WO2018/143058
PCT Pub. Date: Aug. 9, 2018

(65) Prior Publication Data

US 2020/0205523 A1 Jul. 2, 2020

(30) Foreign Application Priority Data

Feb. 1, 2017 (JP) ..... JP2017-016409

(51) Int. Cl.
*A43C 1/06* (2006.01)
*B65H 75/44* (2006.01)
(Continued)

(52) U.S. Cl.
CPC ..... *A43C 1/06* (2013.01); *A43C 11/165* (2013.01); *A44B 11/12* (2013.01); *B65H 75/4402* (2013.01)

(58) Field of Classification Search
CPC ..... A43C 11/165; A43C 1/06; A44B 11/12; B65H 75/4402
See application file for complete search history.

(56) References Cited

U.S. PATENT DOCUMENTS 7,954,204 B2 6/2011 Hammerslag et al.
2006/0156517 A1* 7/2006 Hammerslag ..... A43C 1/04 24/68 SK (Continued)

FOREIGN PATENT DOCUMENTS

JP H06-237802 8/1994
JP 2001-513379 9/2001

(Continued)

*Primary Examiner* — David M Upchurch
(74) *Attorney, Agent, or Firm* — Workman Nydegger

(57) ABSTRACT

An article includes a cord, a cord winding device that tightens and loosens the cord, a drum including a winding portion around which the cord is wound, a drum retainer that accommodates the drum in a rotatable manner, and two cord exits formed in a wall of the drum retainer to guide the cord out of the cord winding device. When the two cord exits and a center of the drum retainer are not located on a single straight line, even if the cord is rewound by a full extent and drawn out from one of the cord exits when the cord is loosened, fatigue that would be caused by kinks reversing a winding direction of the cord or repetitive bending of the cord does not occur at a connecting-fixing portion of the cord and the winding portion corresponding to the other one of the cord exits.

5 Claims, 9 Drawing Sheets

(51) Int. Cl.
*A43C 11/16* (2006.01)
*A44B 11/12* (2006.01)

(56) References Cited

U.S. PATENT DOCUMENTS

| | | | | |
|---|---|---|---|---|
| 2007/0169378 | A1* | 7/2007 | Sodeberg | A43C 11/008 36/50.5 |
| 2010/0139057 | A1* | 6/2010 | Soderberg | A61F 5/0118 24/68 R |
| 2010/0299959 | A1* | 12/2010 | Hammerslag | A43B 5/16 36/50.5 |
| 2013/0092780 | A1* | 4/2013 | Soderberg | A43C 11/165 242/396.4 |
| 2015/0007422 | A1* | 1/2015 | Cavanagh | A43C 11/165 24/68 SK |
| 2015/0014463 | A1* | 1/2015 | Converse | A43C 11/165 242/396.1 |
| 2015/0059206 | A1* | 3/2015 | Lovett | F16G 11/02 36/50.1 |
| 2016/0058130 | A1* | 3/2016 | Boney | A61G 1/044 24/712.6 |
| 2016/0120267 | A1* | 5/2016 | Burns | A43C 9/00 24/68 C |
| 2016/0262496 | A1* | 9/2016 | Midorikawa | A43C 11/165 |
| 2016/0262497 | A1* | 9/2016 | Midorikawa | A43C 11/165 |
| 2020/0008534 | A1* | 1/2020 | Lovett | A43C 7/00 |

FOREIGN PATENT DOCUMENTS

| | | |
|---|---|---|
| JP | 2003-508097 | 3/2003 |
| JP | 2008-525052 | 7/2008 |
| JP | 3159620 | 4/2010 |
| JP | 2010-148927 | 7/2010 |
| JP | 2013-525007 | 6/2013 |
| JP | 2013-530023 | 7/2013 |
| JP | 2015-000293 | 1/2015 |
| JP | 2015-000297 | 1/2015 |
| JP | 2015-516828 | 6/2015 |
| JP | 2016-036679 | 3/2016 |
| JP | 2016-520401 | 7/2016 |
| JP | 2016-525393 | 8/2016 |
| JP | 2016-532841 | 10/2016 |
| JP | 2017-184964 | 10/2017 |
| JP | 2018-023614 | 2/2018 |
| WO | 1999/09850 | 3/1999 |
| WO | 2001/015559 | 3/2001 |
| WO | 2004/110197 | 12/2004 |
| WO | 2006/050266 | 5/2006 |
| WO | 2010/059989 | 5/2010 |
| WO | 2011/137405 | 11/2011 |
| WO | 2012/003396 | 1/2012 |
| WO | 2013/138759 | 9/2013 |
| WO | 2014/047808 | 3/2014 |
| WO | 2014/074645 | 5/2014 |
| WO | 2014/197721 | 12/2014 |
| WO | 2015/003079 | 1/2015 |
| WO | 2015/006616 | 1/2015 |
| WO | 2015/035885 | 3/2015 |
| WO | 2015/039052 | 3/2015 |

* cited by examiner

Prior Art

Prior Art

Prior Art

ARTICLE INCLUDING A CORD WINDING DEVICE

TECHNICAL FIELD

The present invention relates to articles including cord winding devices, where the articles including cord winding devices are athletic shoes used for golf, jogging, or the like and other various types of shoes, bags, body-attached protectors, caps, or the like.

BACKGROUND ART

In the prior art, a cord winding device that is suitable for tightening a shoelace winds a cord around a drum when a dial (disc-shaped knob) is rotated and loosens the cord when the dial is operated (patent documents 1 to 30 listed below).

A wire cord is suitable for use as the cord wound around the drum of such a prior art winding device and thus often used. The wire cord is formed by resin-coating the outer surface of a bundle of stainless steel filaments having superior strength, durability, and handling characteristics.

In the cord winding device of the prior art shown in FIGS. 12 and 13, in which same reference numerals are given to those components that are the same as the corresponding components in the description of one embodiment according to the present invention, connecting-fixing positions of a cord 2 and a drum 4 (positions where cord 2 is drawn out of cord insertion holes 45) are set at point-symmetric positions centered about the rotation center of the drum 4 (positions separated by 180 degrees).

The cord 2 may be broken when cord exits 35, from where the cord 2 wound around the drum 4 are drawn out of a base 3 of the cord winding device, are located near each other, that is, when the cord exits 35 are located at positions separated by 35 to 135 degrees around the rotation center of the drum 4.

In the cord winding device of the prior art, the cord 2 is seldom broken when the positions where the two cord exits 35 are formed and the center of a drum retainer 33 are located on a single straight line.

The cause in the above-described breakage of the cord 2 has been studied in detail. It has become understood that when the positions where the two cord exit 35 are formed and the center of the drum retainer 33 are not located on a single straight line, an effect (kink) that rewinds the cord 2 in the reverse direction near the connecting-fixing positions of the drum 4 and the cord 2 and repetitive bending of the cord 2 results in the accumulation of fatigue (refer to FIG. 13).

The rewinding of the cord in the reverse direction occurs when the cord 2 wound around the drum 4 shown in FIG. 13 as indicated by arrow W is drawn out by the full extent from the cord winding device as shown by arrow W for one reason or another. Such an operation has been overlooked in the prior art. Thus, measures have not been taken to avoid cord breakage.

PRIOR ART LITERATURE

Patent Documents

Patent Document 1: Japanese Laid-Open Patent Publication No. 2015-293

Patent Document 2: Japanese Laid-Open Patent Publication No. 2015-297

Patent Document 3: Japanese National Phase Laid-Open Patent Publication No. 2008-525052

Patent Document 4: International Patent Publication No. WO2006/050266

Patent Document 5: International Patent Publication No. WO2004/110197

Patent Document 6: Japanese Laid-Open Patent Publication No. 2003-508097

Patent Document 7: International Patent Publication No. WO01/15559

Patent Document 8: International Patent Publication No. WO2015/035885

Patent Document 9: Japanese Laid-Open Patent Publication No. 2016-532841

Patent Document 10: International Patent Publication No. WO2015/039052

Patent Document 11: U.S. Pat. No. 7,954,204

Patent Document 12: Japanese Laid-Open Patent Publication No. 2016-525393

Patent Document 13: Japanese Laid-Open Patent Publication No. 2010-148927

Patent Document 14: Japanese Laid-Open Patent Publication No. 2016-36679

Patent Document 15: International Patent Publication No. WO2015/006616

Patent Document 16: International Patent Publication No. WO2015/003079

Patent Document 17: Japanese Laid-Open Patent Publication No. 2016-520401

Patent Document 18: International Patent Publication No. WO2014/197721

Patent Document 19: International Patent Publication No. WO2014/074645

Patent Document 20: Japanese Laid-Open Patent Publication No. 2013-525007

Patent Document 21: International Patent Publication No. WO2011/137405

Patent Document 22: International Patent Publication No. WO2014/047808

Patent Document 23: International Patent Publication No. WO2010/059989

Patent Document 24: Japanese Registered Utility Model No. 3159620

Patent Document 25: International Patent Publication No. WO99/09850

Patent Document 26: Japanese Laid-Open Patent Publication No. 2001-513379

Patent Document 27: International Patent Publication No. WO2013/138759

Patent Document 28: Japanese Laid-Open Patent Publication No. 2015-516828

Patent Document 29: International Patent Publication No. WO2012/003396

Patent Document 30: Japanese Laid-Open Patent Publication No. 2013-530023

Patent Document 31: Japanese Patent Application No. 2016-75374 (Japanese Laid-Open Patent Publication No. 2017-184964)

Patent Document 32: Japanese Patent Application No. 2016-157594

SUMMARY OF THE INVENTION

Problems to be Solved by the Invention

The present invention aims to provide an article including a cord winding device that effectively prevents breakage of the cord in which rewinding (kink) of the cord does not occur and fatigue that would be caused by repetitive bending of the cord does not accumulate at the connecting-fixing positions of the drum and cord even when the cord is drawn out of the cord winding device by the full extent.

It is an object of the present invention to provide an article including a cord winding device that avoids the occurrence of kinks in the cord and the accumulation of fatigue in the cord so as to increase strength, durability, and reliability in addition to facilitating maintenance or repair.

Means for Solving the Problem (1) The most significant feature of the present invention in in "An article including a cord winding device, comprising: a cord; a cord winding device that allows the cord to be tightened and loosened; a drum including a winding portion around which the cord is wound; a drum retainer that accommodates the drum in a rotatable manner; and two cord exits formed in a peripheral wall of the drum retainer to guide the cord from an inner surface of the peripheral wall out of the cord winding device, wherein when positions where the two cord exits are formed and a center of the drum retainer are not located on a single straight line, even if the cord is rewound by a full extent and drawn out from one of the cord exits when the cord is loosened, fatigue that would be caused by kinks reversing a winding direction of the cord or repetitive bending of the cord does not occur at a connecting-fixing portion of the cord and the winding portion corresponding to the other one of the cord exits."

(2) In the article including a winding device according to the present invention, angle α by which two connecting-fixing positions, from where the cord is drawn out from the winding portion, are separated is less than 180 degrees to correspond with the positions where the two cord exits are formed so that even if the cord is rewound by the full extent and drawn out from one of the cord exits when the cord is loosened, fatigue that would be caused by kinks reversing a winding direction of the cord or repetitive bending of the cord does not occur at the connecting-fixing portion of the cord and the winding portion corresponding to the other one of the cord exits.

(3) In the article including a winding device according to the present invention, by changing an order for inserting the cord through cord insertion hole groups, each including three cord insertion holes, located at point-symmetric positions in the winding portion of the drum, even if the cord is rewound by the full extent and drawn out from one of the cord exits when the cord is loosened, fatigue that would be caused by kinks reversing a winding direction of the cord or repetitive bending of the cord does not occur at the connecting-fixing portion of the cord and the winding portion corresponding to the other one of the cord exits.

(4) In the article including a winding device according to the present invention, by inserting the cord through cord insertion hole groups, each including three cord insertion holes, formed avoiding point-symmetric positions in the winding portion of the drum, even if the cord is rewound by the full extent and drawn out from one of the cord exits when the cord is loosened, fatigue that would be caused by kinks reversing a winding direction of the cord or repetitive bending of the cord does not occur at the connecting-fixing portion of the cord and the winding portion corresponding to the other one of the cord exits.

(5) In the article including a winding device according to the present invention, an angle difference (α-β) of angle α by which two connecting-fixing positions, from where the cord is drawn out from the winding portion, are separated and angle β by which the two cord exits are separated in an inner surface of the peripheral wall is included in a range of 0 degrees to 45 degrees.

(6) In the article including a winding device according to the present invention, angle α by which the two connecting-fixing positions, from where the cord is drawn out from the winding portion, are separated is included in a range of 60 degrees to 170 degrees, angle β by which the two cord exits are separated in an inner surface of the peripheral wall is included in a range of 60 degrees to 125 degrees, and angle α is not smaller than angle β.

(7) In the article including a winding device according to the present invention, angle α by which the two connecting-fixing positions, from where the cord is drawn out from the winding portion, are separated is included in a range of 70 degrees to 125 degrees, and angle β by which the two cord exits are separated in the inner surface of the peripheral wall is included in a range of 70 degrees to 90 degrees.

Effect of the Invention (1) In the article including a winding device according to the present invention described above, even when the cord is drawn out by the full extent from the cord winding device for one reason or another, fatigue that would be caused by rewinding of the cord in the reverse direction (kink) or repetitive bending of the cord does not occur. Thus, the cord will not break.

Accordingly, the article including the wiring device increases the durability and reliability of the cord winding device and provides an article including the winding device that facilitate maintenance and repair.

(2) In the article including a winding device according to the present invention, when angle α by which the two connecting-fixing positions, from where the cord is drawn out from the winding portion, are separated is less than 180 degrees, the occurrence of kink and the accumulation of fatigue can be prevented by changing the location of the connecting-fixing positions of the cord and the winding portion without greatly changing the shape of the drum. Further, the article including the winding device can be provided at a lower cost.

(3) In the article including a winding device according to the present invention, when changing an order for inserting the cord through cord insertion hole groups, each including three cord insertion holes, located at point-symmetric positions in the winding portion of the drum, the occurrence of kink and the accumulation of fatigue can be easily prevented without greatly changing the shape of the drum, and the durability and reliability of the cord winding device can be increased without increasing costs.

(4) In the article including a winding device according to the present invention, when inserting the cord through cord insertion hole groups, each including three cord insertion holes, formed avoiding point-symmetric positions in the winding portion of the drum, the cord insertion hole groups can be located closer without greatly changing the shape of the drum. This easily prevents the occurrence of kink and the accumulation of fatigue and increases the durability and reliability of the cord winding device.

(5) In the article including a winding device according to the present invention, an angle difference (α-β) of angle α by which two connecting-fixing positions, from where the cord is drawn out from the winding portion, are separated and angle β by which the two cord exits are separated in an inner surface of the peripheral wall is included in a range of 0 degrees to 45 degrees. This ensures that the occurrence of kink and the accumulation of fatigue is limited and further increases the durability and reliability of the cord winding device.

(6) In the article including a winding device according to the present invention, angle α by which the two connecting-fixing positions, from where the cord is drawn out from the winding portion, are separated is included in a range of 60 degrees to 170 degrees, angle β by which the two cord exits are separated in an inner surface of the peripheral wall is included in a range of 60 degrees to 125 degrees, and angle α is not smaller than angle β. This ensures that the occurrence of kink and the accumulation of fatigue is limited and further increases the durability and reliability of the cord winding device.

(7) In the article including a winding device according to the present invention, angle α by which the two connecting-fixing positions, from where the cord is drawn out from the winding portion, are separated is included in a range of 70 degrees to 125 degrees, and angle β by which the two cord exits are separated in the inner surface of the peripheral wall is included in a range of 70 degrees to 90 degrees. This ensures that the occurrence of kink and the accumulation of fatigue is limited and further increases the durability and reliability of the cord winding device.

BRIEF DESCRIPTION OF THE DRAWINGS

FIG. 5 shows a drum of the cord winding device according to one embodiment of the present invention, in which FIG. 5A is a perspective view showing an upper surface side, FIG. 5B is a perspective view showing a lower side, FIG. 5C is a plan view, FIG. 5D is a side view, and FIG. 5E is a bottom view.

FIG. 6 shows a dial of the cord winding device according to one embodiment of the present invention, in which FIG. 6A is a bottom view, FIG. 6B is a perspective view showing a lower side, FIG. 6C is a plan view, FIG. 6D is a perspective view of an upper side.

EMBODIMENTS OF THE INVENTION

The present invention, which can be applied to the embodiments described below is "An article including a cord winding device, comprising: a cord; a cord winding device that allows the cord to be tightened and loosened; a drum including a winding portion around which the cord is wound; a drum retainer that accommodates the drum in a rotatable manner; and two cord exits formed in a peripheral wall of the drum retainer to guide the cord from an inner surface of the peripheral wall out of the cord winding device, wherein when positions where the two cord exits are formed and a center of the drum retainer are not located on a single straight line, even if the cord is rewound by a full extent and drawn out from one of the cord exits when the cord is loosened, fatigue that would be caused by kinks reversing a winding direction of the cord or repetitive bending of the cord does not occur at a connecting-fixing portion of the cord and the winding portion corresponding to the other one of the cord exits."

A shoe including a cord winding device that winds a shoelace, which is one example of a cord, will now be described as one embodiment (one embodiment: FIGS. 1 to 6) of an article including a cord winding device according to the present invention.

The interior structure of the embodiment of the cord winding device used in the present embodiment and its operation and advantages have already been partially disclosed by the applicant in the patent documents described above, such as Japanese Patent Application No. 2013-127574 (Japanese Laid-Open Patent Publication No. 2015-293), Japanese Patent Application No. 2013-127612 (Japanese Laid-Open Patent Publication No. 2015-297), and Japanese Patent Application No. 2014-163867 (Japanese Laid-Open Patent Publication No. 2016-36679).

Figure 1:
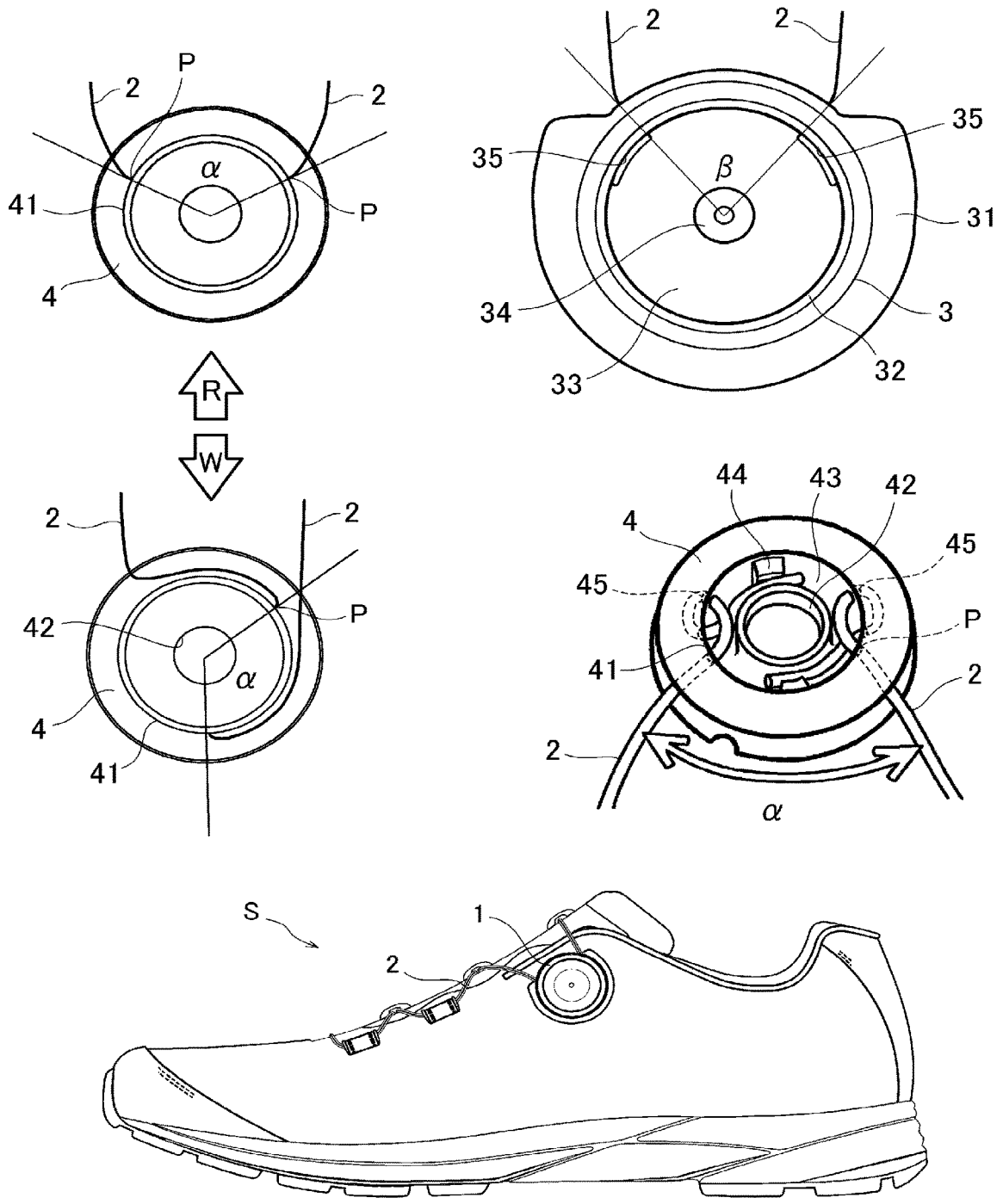
FIG. 1 includes a plan view and a perspective view of a drum of a cord winding device according to one embodiment of the present invention, a plan view showing the location of a cord exit in a base member, and a side view of an article (shoe) including the cord winding device.
Figure 2:
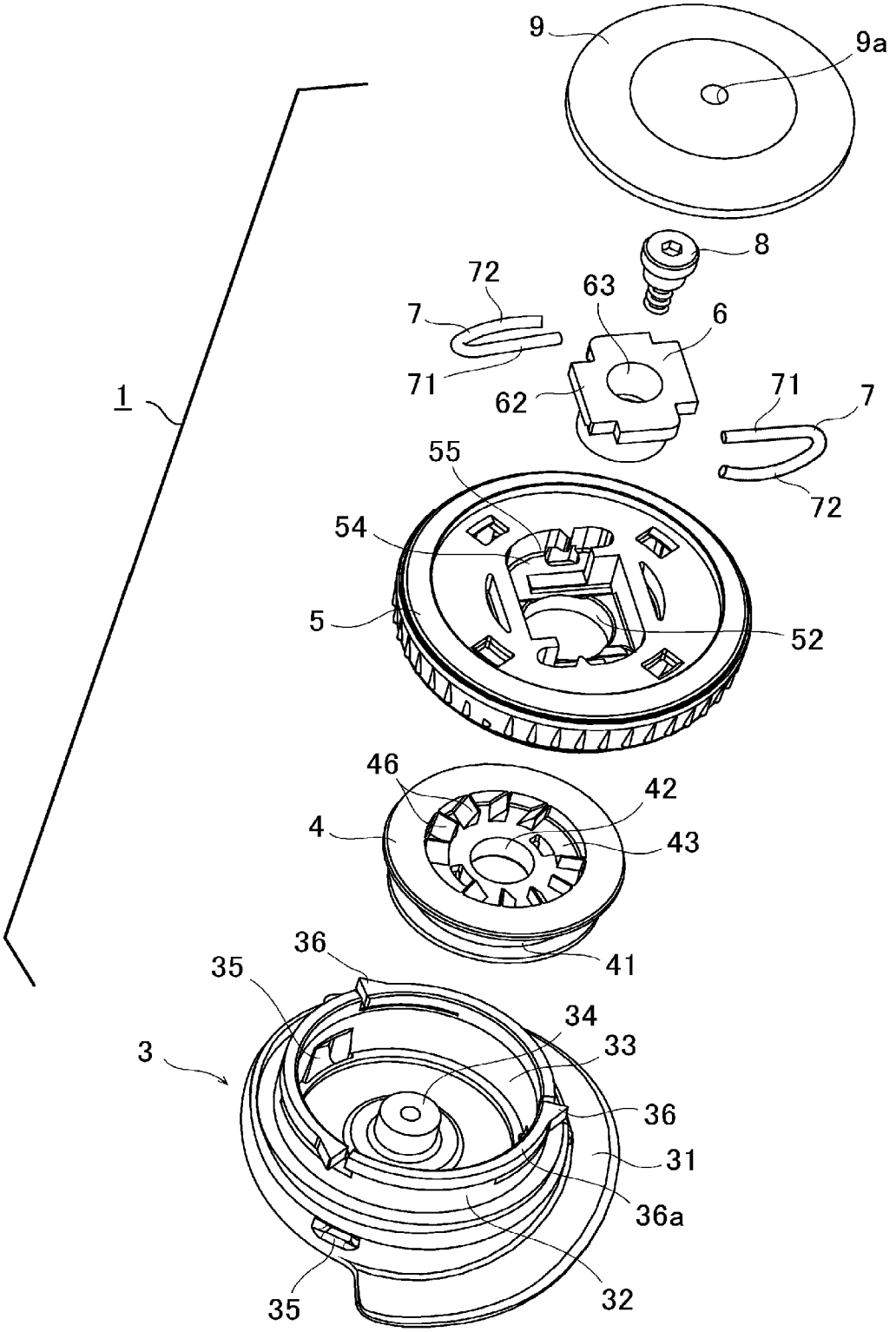
FIG. 2 is an exploded perspective view of the cord winding device according to one embodiment of the present invention.

FIG. 1 shows a shoe S including a cord winding device according to one embodiment of the present invention located at a position corresponding to the ankle. With the shoe S, a shoelace 2 formed by a resin-coated metal wire tightens the foot top portion of the shoe S.

Examples of a "cord" suitable for use with the cord winding device according to the present invention are listed below. However, there is no limit to these examples.

1. A resin-coated wire cord of a bundle of filaments formed from metal such as stainless steel,
2. A cord formed by bundling or braiding filaments or strings of metal or resin (multi-filament), and
3. A single cord formed from metal or resin (monofilament).

The winding device 1 includes a base member 3, a drum 4 that winds the shoelace 2, a substantially disc-shaped dial 5 that rotates and drives the drum 4, a shaft member 6 that attaches the dial 5 to the base member 3 in a manner rotatable relative to the base member 3, spring members 7 each including one end pivotally supported by the shaft member 6, a screw 8, and a cover member 9.

Preferably, the shoelace 2 is a wire cord, which is coated with nylon resin obtained by twisting together stainless steel strands having a diameter of 0.11 to 0.13 mm into a wire rope and processing the wire rope with a swaging machine, or a mono-filament cord, which is formed from nylon resin.

The entire base member 3 is integrally molded by forming a thin flange 31 that projects from the periphery of a drum retainer 33 including a tube-shaped peripheral wall 32 accommodating the drum 4 in a rotatable manner. The flange 31 is sewn and fixed to the shoe S to fix the cord winding device 1 to the shoe S.

A rotation shaft 34 that supports the drum 4 projects from the middle portion (central portion) of the inner bottom part of the drum retainer 33.

The bottom part of the drum retainer 33 includes the two cord exits 35 extending through the peripheral wall 32 and connected to the outside. In the cord winding device 1 of this embodiment, angle β by which the two cord exits 35 are separated in the inner surface of the peripheral wall 32 is set to approximately 80 degrees about the center of the drum retainer 33.

More specifically, the positions where the two cord exits 35 are formed and the center of the drum retainer 33 are not located on a single straight line.

In a further embodiment of the cord winding device, angle β may be included in a range of 60 degrees to 125 degrees or in a range of 70 degrees to 90 degrees.

The upper end of the peripheral wall 32 includes three claws 36 formed at equal intervals and projected outward from the peripheral wall 32. Each claw 36 is located on the end of a curved, elongated, rod-like spring portion 36*a* that is cut out in an arcuate manner from part of the peripheral wall 32.

The spring portions 36*a* are elastically deformed to move the claws 36 toward the inner side of the drum retainer 33.

The drum 4 includes a tubular winding portion 41 around which the shoelace 2 is wound and held and a tubular rotation shaft portion 42 located at the inner side of the winding portion 41. The upper and lower surfaces of the drum 4 each include a recess 43 extending between the winding portion 41 and the rotation shaft portion 42.

The rotation shaft 34 of the base member 3 is inserted into the rotation shaft portion 42, and the drum 4 is rotatable in the drum retainer 33.

The recess 43 in the lower side of the drum 4 is opposed to the inner bottom part of the drum retainer 33. Two engagement projections 44 are arranged in the recess 43.

The engagement projections 44 are used to clamp and hold the tip of the shoelace 2 in the recess 43. The shoelace 2 is drawn into the recess 43 through a plurality of (six in total) of cord insertion holes 45 extending through the winding portion 41.

The cord insertion holes 45 are arranged at positions separated by 180 degrees about the rotation center of the drum 4, with three cord insertion holes 45 located near one another at each of the two positions. More specifically, the three cord insertion holes 45 located near one another form a single cord insertion hole group, and the cord insertion hole groups are formed at point-symmetric positions about the rotation center of the drum 4.

Such an arrangement of the cord insertion hold groups is also employed in a drum of the prior art. Thus, the drum of the prior art can be used without any changes in the structure of the present invention.

Such a structure will be described later.

The upper recess 43 of the drum 4 includes upwardly-directed teeth 46 formed along the inner surface of the winding portion 41 for engagement with downwardly-directed teeth 51 formed on the lower surface of the dial 5 to transmit the rotation of the dial 5 to the drum 4.

The central part of the dial 5 includes a shaft hole 52, and the downwardly-directed teeth 51 are formed in an annular arrangement around the shaft hole 52.

Further, the dial 5 includes an annular gear 53 including a plurality of peaks and valleys arranged in a tubular manner and extending in the axial direction of the dial 5.

The valleys of the annular gear 53 are arranged to be engaged with the claws 36. When the dial 5 is rotated, the claws 36 move beyond the peaks of the annular gear so as to allow the dial 5 to be rotated in only one direction.

More specifically, the annular gear 53 and the claws 36 form a ratchet mechanism, and the peaks of the annular gear 53 have a "sawteeth" cross section so that the annular gear 53 (dial 5) can be rotated only in the direction that tightens the shoelace 2.

The dial 5 is movable in the direction of its rotation axis. The upwardly-directed teeth 46 is engaged with the downwardly-directed teeth 51 in a lock state (state shown in FIG. 3) in which the rotation of the dial 5 is transmitted to the drum 4. The upwardly-directed teeth 46 is disengaged from the downwardly-directed teeth 51 in an unlock state (state shown in FIG. 4) that separates the dial 5 from the drum 4 and allows the drum 4 to be freely rotated.

The shaft member 6 is fixed by the screw 8 to the base member 3 to attach the dial 5 in a manner rotatable to the base member 3. The shaft member 6 holds and guides the dial 5 to be movable between a lock position where the dial 5 is located near the drum 4 and an unlock position where the dial 5 is separated from the drum 4.

The shaft member 6 is cylindrical. Bearings are formed near the upper end of the shaft member 6 by cutting out sides opposing each other in a direction orthogonal to the axial direction of the shaft member 6. One straight end (pin 71) of each spring member 7 is inserted into the corresponding bearing. This pivotally supports the spring member 7.

The spring members 7 are arranged in spring accommodation portions 54 formed adjacent to the shaft hole 52 of the dial 5. Each spring member 7 is bent to be generally U-shaped as a whole so that its other end 72 is constantly in contact with an engagement portion 55 arranged in the corresponding spring accommodation portion 54.

Movement of the dial 5 from the lock position to the unlock position allows the drum 4 to be switched from a lock state to an unlock state.

Further, a reversing position where the other end 72 of the spring member 7 is compressed most strongly against the shaft member 6 is set between the lock position and the unlock position to clearly indicate switching of the position of the dial 5.

The disc-shaped cover member 9 is fitted to the upper side of the dial 5 to protect the inside of the cord winding device 1 so that foreign matter does not enter the cord winding device 1.

The central portion of the cover member 9 includes a through hole 9*a*. The screw 8 located at the inner side (lower side) of the cover member 9 is operated through the through hole 9*a* to remove the drum 4, the dial 5, the shaft member 6, and the like from the base member 3.

A method for assembling and manufacturing the cord winding device 1 will now be described.

First, the tips of the shoelace 2 are respectively inserted into the two cord exits 35 from the outer side of the base member 3. Then, the two tips of the shoelace 2 are drawn into the drum retainer 33.

The tips of the shoelace 2 are sequentially inserted in a meandering manner into the six cord insertion holes 45 in the winding portion 41 of the drum 4 to fix the two tips of the shoelace 2 to the drum 4. Then, the drum 4 is arranged in the drum retainer 33.

The positions where the shoelace 2 is drawn out of the drum 4 from the cord insertion holes 45, that is, the positions where the shoelace 2 is drawn out of the winding portion 41 are referred to as "connecting-fixing portions P" of the winding portion 41 and the shoelace 2 in the present invention.

Particularly, in the present embodiment, by changing the order for inserting the shoelace 2 into the cord insertion hole groups, each including three cord insertion holes 45, formed at point-symmetric positions in the winding portion 41 of the drum 4, angle α by which the connecting-fixing portions P where the shoelace 2 is drawn out of the winding portion 41 are separated can be set to less than 180 degrees to correspond with the positions where the two cord exits 35 are formed.

More specifically, in the cord winding device 1 of the present embodiment, the tips of the shoelace 2 are inserted into the recess 43 from the cord insertion holes 45 that are closest to each other in the two cord insertion hole groups. Thus, angle α by which the two connecting-fixing portions P from where the shoelace 2 is drawn out of the winding portion 41 are separated is approximately 125 degrees.

When the above structure is employed, the angular difference (α-β) of angle α by which the two connecting-fixing portions P from where the shoelace 2 is drawn out of the winding portion 41 are separated and angle β by which the cord exits 35 are separated in the peripheral wall 32 is approximately 45 degrees.

Accordingly, even if the shoelace 2 is drawn out from one of the cord exits 35 and rewound by the full extent when loosening the shoelace 2, fatigue that would be caused by kinks reversing the winding direction of the shoelace 2 or repetitive bending of the shoelace 2 does not occur at the connecting-fixing portion P of the shoelace 2 and the winding portion 41 corresponding to the other cord exit 35.

More specifically, in the drum 4 shown in FIG. 1, from a state in which the shoelace 2 is wound as indicated by arrow W, if the shoelace 2 is drawn out of the cord winding device 1 by the full extent for one reason or another like the drum 4 indicated by arrow R, the occurrence of kink and the accumulation of fatigue can be prevented. This differs from the drum 4 shown in FIG. 13.

Figure 12:
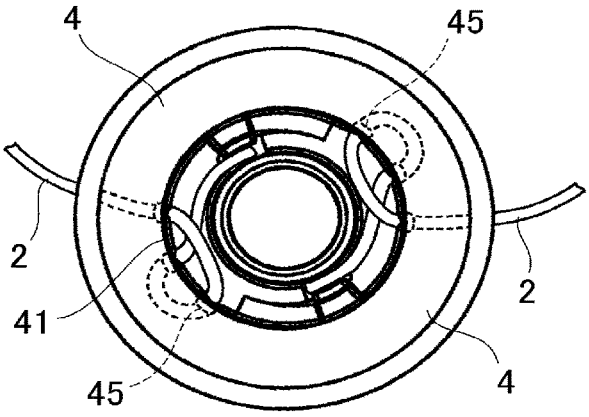
FIG. 12 includes a bottom view showing a drum of a prior art cord winding device and a perspective view of the bottom side.
Figure 12:
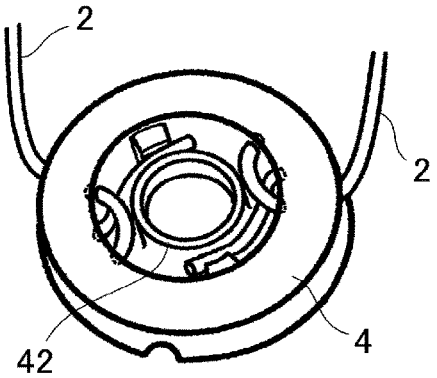
Figure 13:
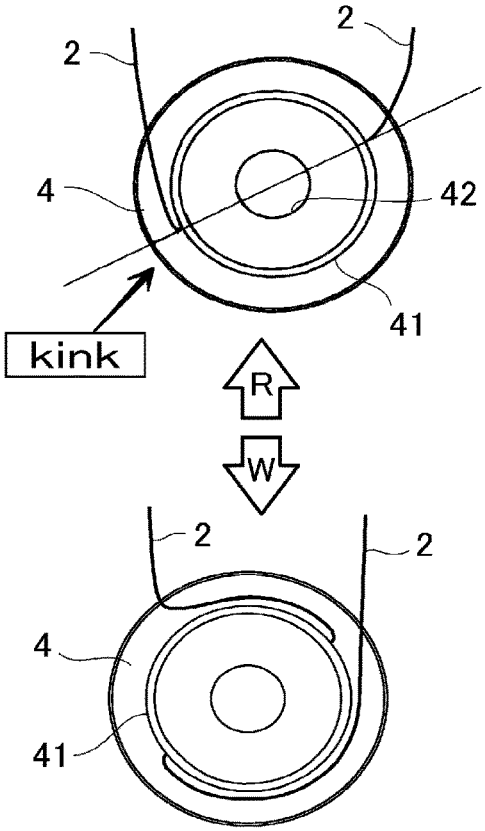
Prior Art Fig. 13
FIG. 13 includes a plan view of the drum of the prior art cord winding device and a plan view showing positions of cord exits in a base member.
Figure 13:
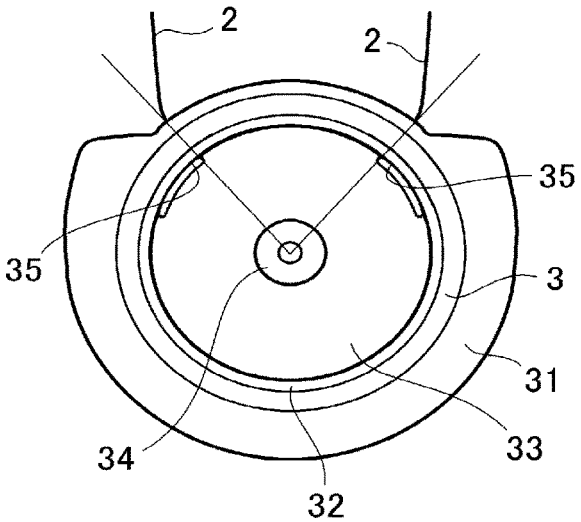
Prior Art Fig. 13

The structure of the prior art winding device will be described again. In the prior art winding device, as shown in FIGS. 12 and 13, the order for inserting the cord 2 through the cord insertion holes 45 of the drum 4 is such that the cord 2 is inserted through the cord insertion holes 45 located at point-symmetric positions separated by 180 degrees about the center of the drum 4 and the cord 2 is drawn out of the winding portion 41 from the two connecting-fixing portions separated by an angle of 180 degrees. Accordingly, in the prior art winding device, the two connecting-fixing portions where the cord 2 is drawn out of the winding portion 41 does not correspond to the positions where the two cord exits 35 are formed in the base member 3.

More specifically, in the cord winding device of the prior art structure shown in FIGS. 12 and 13, the angular difference of the angle by which the two connecting-fixing portions where the cord 2 is drawn out of the winding portion 41 are separated and the angle by which the two cord exits 35 in the inner surface of the peripheral wall 32 are separated is approximately 100 degrees.

Accordingly, in the structure of the prior art cord winding device, if the cord 2 is drawn out from one of the cord exits 35 and rewound by the full extent when loosening the cord 2, fatigue will be caused by a kink that reverses the winding direction of the cord 2 or repetitive bending of the cord 2 at the connecting-fixing portion of the cord 2 and the winding portion 41 corresponding to the other cord exit 35. This may break the cord 2.

In a further embodiment of an article (shoe S or the like) including the cord winding device 1 of the present invention, if the shoelace 2 is drawn out from one of the cord exits 35 and rewound by the full extent when loosening the shoelace 2, to avoid fatigue that would be caused by kinks reversing the winding direction of the shoelace 2 or repetitive bending of the shoelace 2 at the connecting-fixing portion P of the shoelace 2 and the winding portion 41 corresponding to the other cord exit 35, it has been confirmed through experiments that it is significant that the angular difference (α-β) of angle α by which the two connecting-fixing portions P where the shoelace 2 is drawn out of the winding portion 41 are separated and angle β by which the cord exits 35 in the inner surface of the peripheral wall 32 are separated be in the range of 0 degrees to 45 degrees.

Further, as long as angle α by which the two connecting-fixing portions P from where the shoelace 2 is drawn out of the winding portion 41 are separated is included in the range of 60 degrees to 170 degrees, angle β by which the two cord exits 35 in the inner surface of the peripheral wall 32 are separated is included in the range of 60 degrees to 125 degrees, and angle α is not smaller than angle β, even if the shoelace 2 is drawn out from one of the cord exits 35 and rewound by the full extent when loosening the shoelace 2, an article including the cord winding device 1 can avoid fatigue that would be caused by kinks reversing the winding direction of the shoelace 2 or repetitive bending of the shoelace 2 at the connecting-fixing portion P of the shoelace 2 and the winding portion 41 corresponding to the other cord exit 35.

Further, as long as angle α by which the two connecting-fixing portions P from where the shoelace 2 is drawn out of the winding portion 41 are separated is included in the range of 70 degrees to 125 degrees and angle β by which the two cord exits 35 in the inner surface of the peripheral wall 32 are separated is included in the range of 70 degrees to 90 degrees, even if the shoelace 2 is drawn out from one of the cord exits 35 and rewound by the full extent when loosening the shoelace 2, an article including the cord winding device 1 can avoid fatigue that would be caused by kinks reversing the winding direction of the shoelace 2 or repetitive bending of the shoelace 2 at the connecting-fixing portion P of the shoelace 2 and the winding portion 41 corresponding to the other cord exit 35.

The dial 5 is then coupled to the shaft member 6 and the spring member 7.

A flange 62 formed projecting from the upper end of the shaft member 6 is abut against the dial 5 around the shaft hole 52 so that the dial 5 is not separated from the shaft member 6.

After coupling the dial 5, the shaft member 6, and the spring member 7 through the procedure described above, the screw 8 is inserted through a screw insertion hole 63 extending along the axis of the shaft member 6. Then, the screw 8 is fastened to the rotation shaft 34 to attach the shaft member 6 to the base member 3.

Finally, the cover member 9 is fitted to the dial 5 and coupled to the cord winding device 1.

When disassembling the cord winding device 1 for maintenance or repair, a screwdriver is inserted into the through hole 9*a* of the cover member 9 to unfasten the screw 8 so that the coupled dial 5, shaft member 6, and spring members 7 can be removed from the base member 3.

The materials listed below are used to form the members of the cord winding device 1 according to the present invention take into consideration strength, durability, elasticity, and the like. However, there is not limitation to these materials.

base member 3—nylon drum 4, shaft member 6—polyacetal (POM)

dial 5—nylon and, in periphery, thermoplastic elastomer (TPE)

spring member 7—stainless steel screw 8—carbon steel cover member 9—ABS resin A method for using the cord winding device 1 will now be described.

Figure 3:
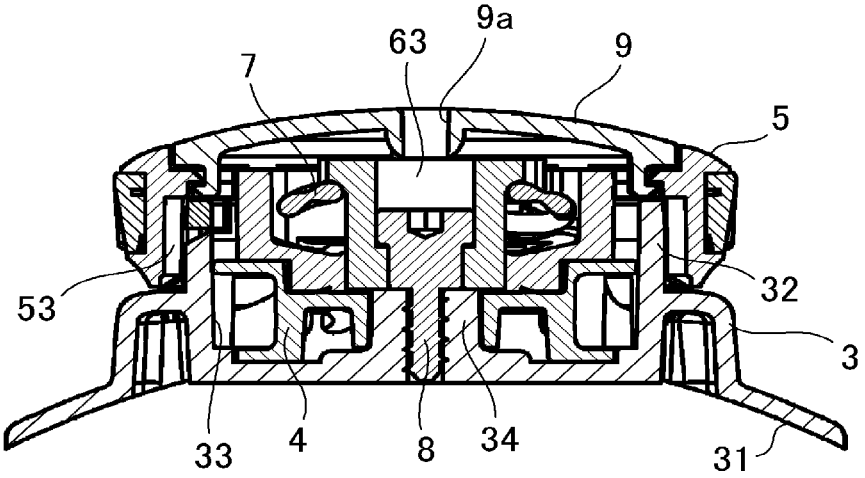
FIG. 3 is a vertical, cross-sectional view showing a lowered state of a dial of the cord winding device according to one embodiment of the present invention.
Figure 4:
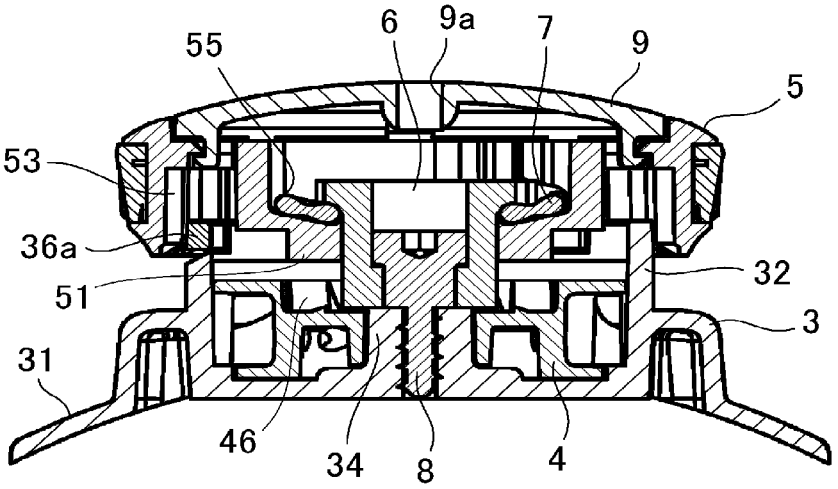
FIG. 4 is a vertical, cross-sectional view showing a raised state of a dial of the cord winding device according to one embodiment of the present invention.
Figure 5:
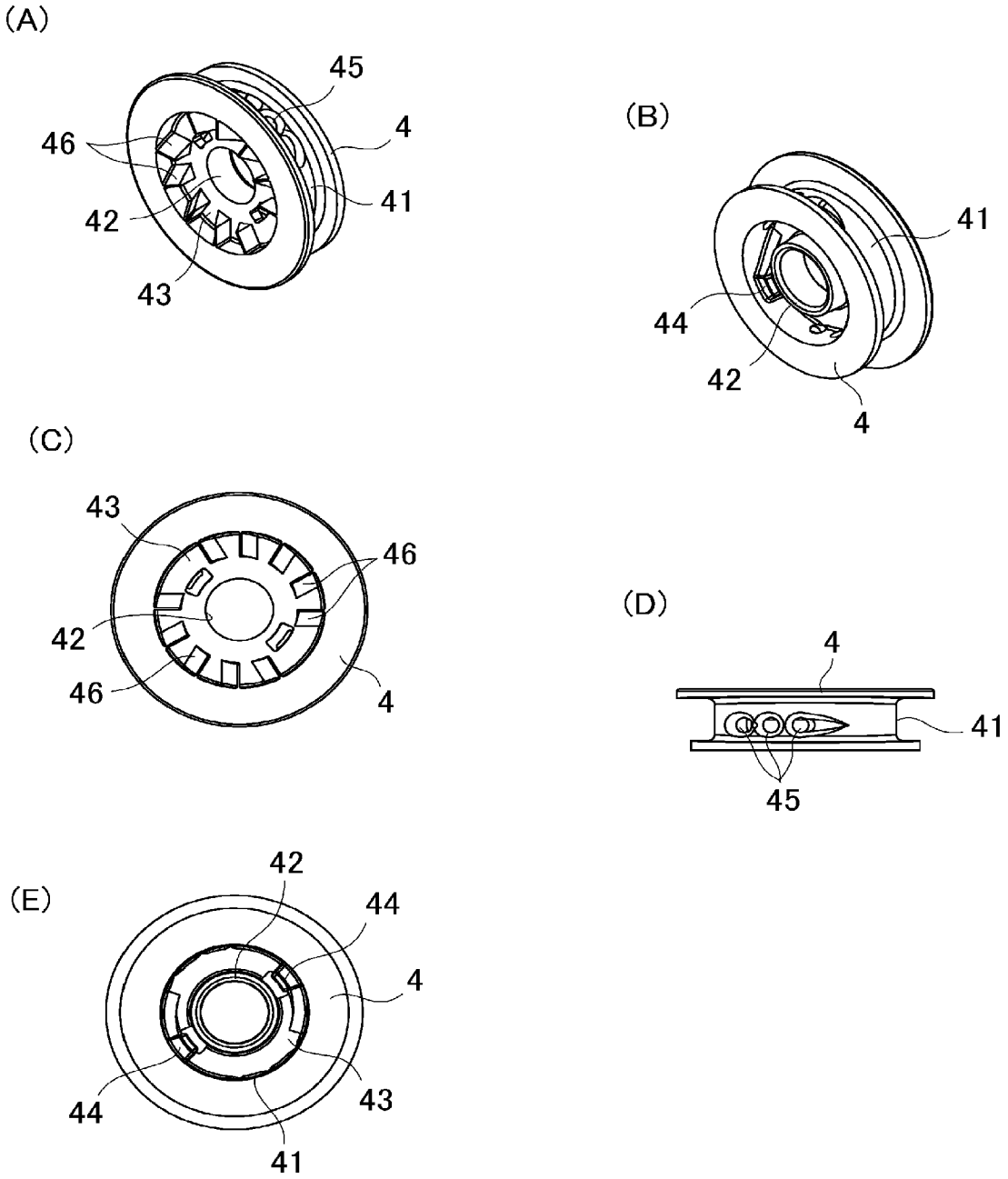
Figure 6:
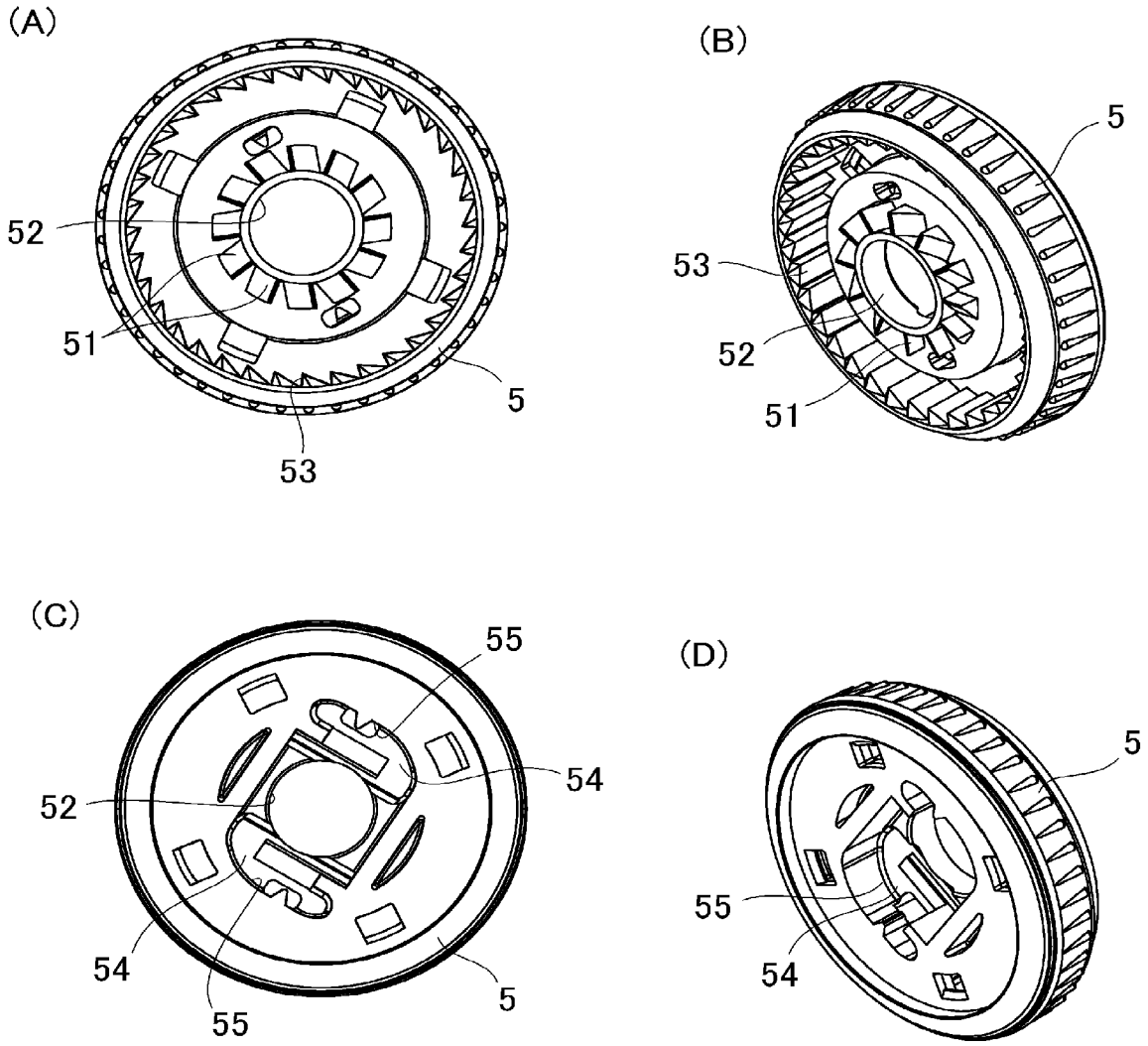

After putting on the shoe S, to tighten the shoelace 2, the dial 5 of the cord winding device 1 shown in FIG. 3 is rotated at the lock position where the dial 5 is located near the base member 3 to wind the shoelace 2 around the drum 4.

In this case, the peaks in the annular gear 53 of the dial 5 abut against the claws 36. Thus, the drum 4 is not rotated in the direction that loosens the shoelace 2.

To loosen the shoelace 2, the dial 5 of the cord winding device 1 is pulled upward beyond the reversing position where the spring members 7 are compressed most strongly and the direction in which the spring members 7 are compressed switches between the lock position and the unlock position. This moves the dial 5 to the unlock position where the dial 5 is separated from the base member 3 (state shown in FIG. 4).

In contrast, when pushing and moving the dial 5 downward from the unlock position to the lock position, the dial 5 is moved beyond the reversing position where the spring members 7 are compressed most strongly. Then, the upwardly-directed teeth 46 of the drum 4 mesh again with the downwardly-directed teeth 51 of the dial 5. This allows the shoelace 2 to be wound around the drum 4 so as to tighten the shoelace 2.

The present invention is not limited to the cord winding device 1 arranged at the foot top portion of the shoe S and may be embodied in a cord winding device that tightens the shoelace 2 at a different location on the shoe S.

Figure 7:
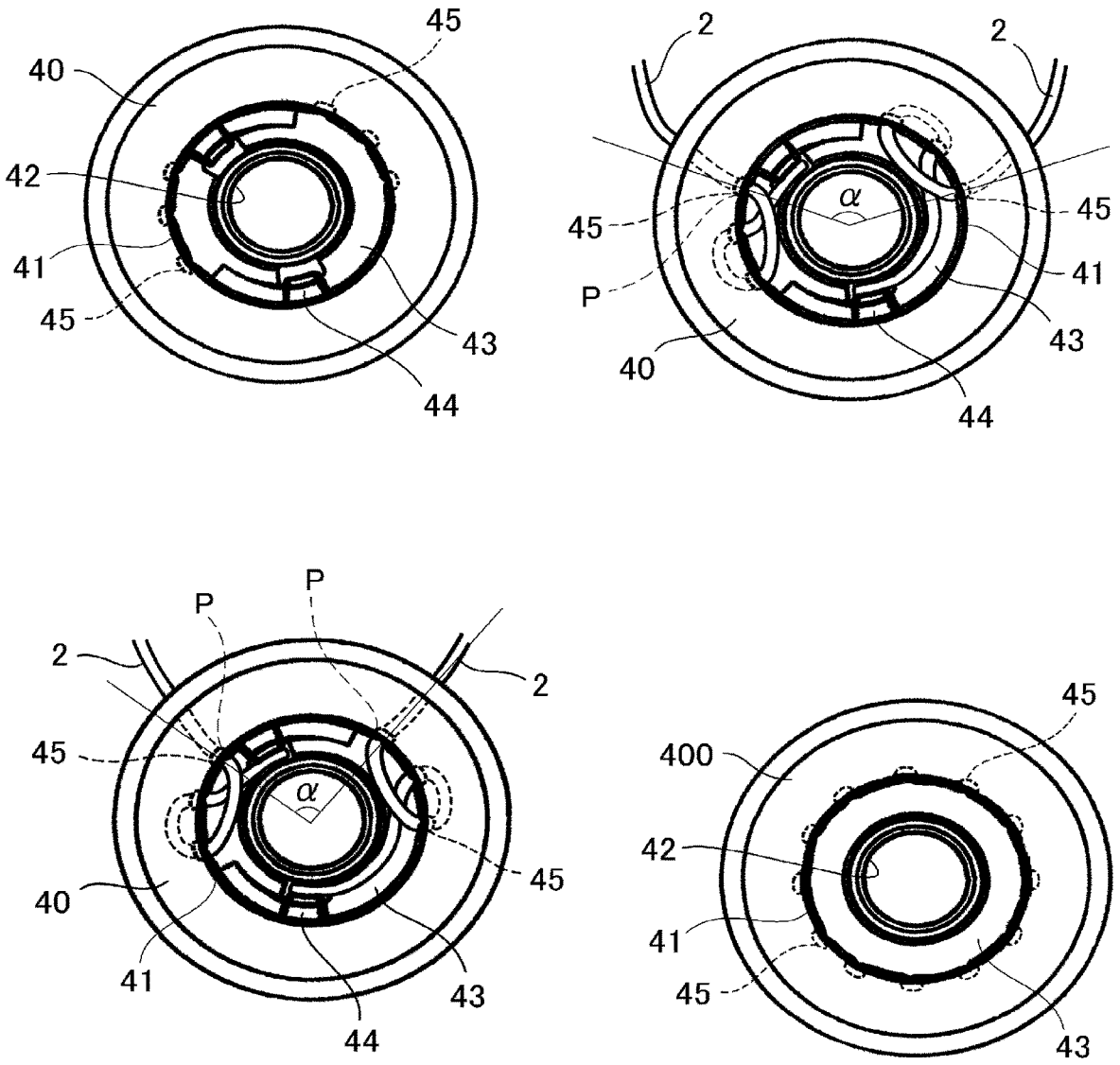
FIG. 7 includes a bottom view of the drum of the cord winding device according to a further embodiment of the present invention and a bottom view showing a state in which an end of a cord is fixed to the drum.

Further, a drum 40 shown in FIG. 7 may be used in a further embodiment of an article including a cord winding device according to the present invention.

Same reference numerals are given to those components that are the same as the corresponding components of the drum 4 in the above embodiment. Such components will not be described in detail.

To obtain the advantages of the drum 40, the cord insertion holes 45 (cord insertion hole groups) are formed at closer positions (cord insertion hole groups arranged at positions that are not point-symmetric about rotation center of drum) to decrease the angle by which the two connecting-fixing portions P of the shoelace 2 and the drum 40 of the winding portion 41 are separated.

In the drum 40 of the present embodiment, angle α by which the two connecting-fixing portions P from where the shoelace 2 is drawn out of the winding portion 41 are separated is in the range of 60 degrees to 170 degrees.

More specifically, angle α by which the two connecting-fixing portions P from where the shoelace 2 is drawn out of the winding portion 41 are separated is approximately 140 degrees (refer to drum 40 illustrated in upper right side of FIG. 7).

In this manner, when using the drum 40 in which the cord insertion holes 45 (cord insertion hole groups) are formed at closer positions, the order for inserting the ends of the shoelace 2 into the three cord insertion holes 45 of the corresponding cord insertion hole groups can be changed so that angle α by which the two connecting-fixing portions P from where the shoelace 2 is drawn out of the winding portion 41 are separated is further decreased to be included in the range of approximately 60 degrees to 125 degrees or approximately 70 degrees to 125 degrees (refer to drum 40 illustrated in lower left side of FIG. 7).

Figure 8:
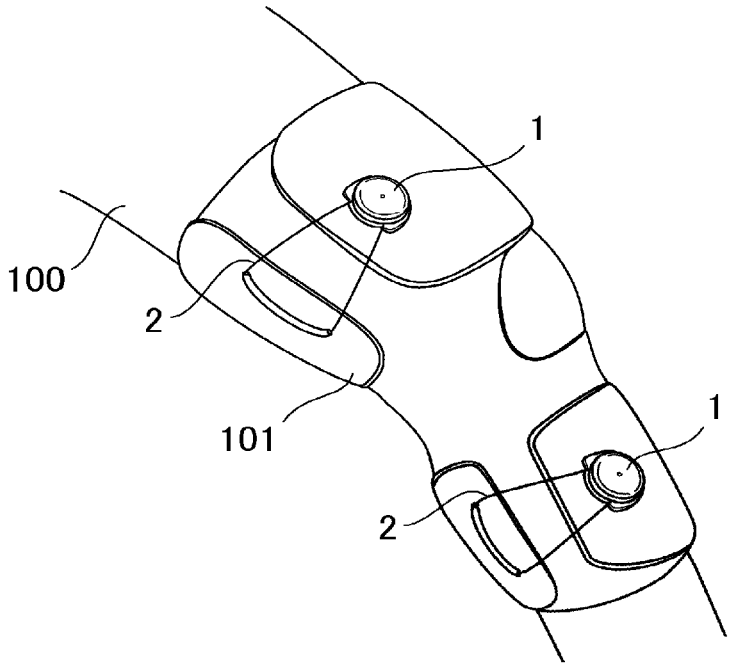
FIG. 8 is a perspective view showing an article (body protector) including a cord winding device according to a further embodiment of the present invention.

As shown in FIG. 8, another embodiment of an article including the cord winding device 1 according to the present invention may be a protector 101 attached to a body 100 such as a leg, an arm, or the waist. The protector 101 may be an article used for medical purposes or an article used for sports.

Figure 9:
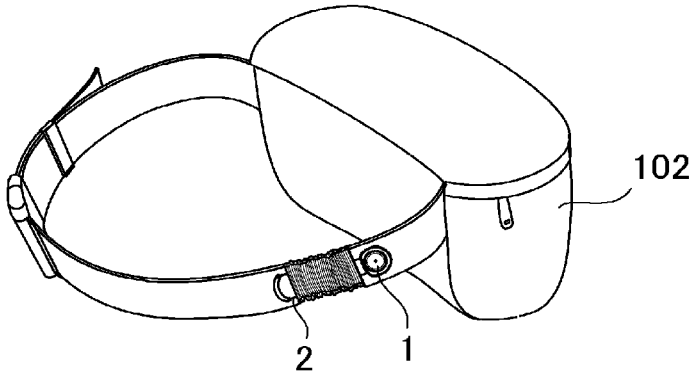
FIG. 9 is a perspective view showing an article (holding implement) including a cord winding device according to a further embodiment of the present invention.

As shown in FIG. 9, another embodiment of an article including the cord winding device 1 according to the present invention may be a holding implement 102 such as a pochette (handbag), a bag, a knapsack, or a school bag.

Figure 10:
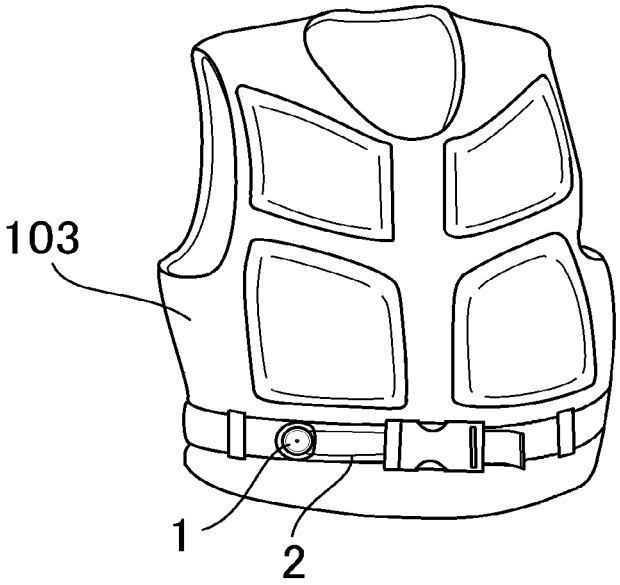
FIG. 10 is a perspective view showing an article (clothing) including a cord winding device according to a further embodiment of the present invention.

As shown in FIG. 10, another embodiment of an article including the cord winding device 1 according to the present invention may be clothing 103 such as a lifejacket, a uniform, a raincoat, and a jacket.

Figure 11:
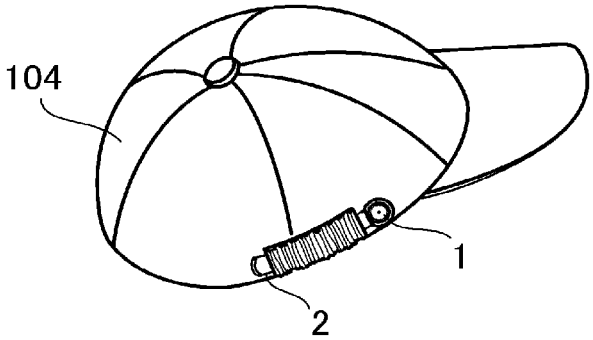
FIG. 11 is a perspective view showing an article (cap) including a cord winding device according to a further embodiment of the present invention.

As shown in FIG. 11, another embodiment of an article including the cord winding device 1 according to the present invention may be a cap 104, a helmet, or the like.

The cord winding device 1 according to the present invention can be attached to an article such as those described in the other embodiments to tighten or loosen a cord so that the article is fitted to the body. This improves the convenience of the article, prevents breakage of the cord, and increases durability.

The feature of the present invention is in the relationship of the positions of connecting-fixing portions of a drum and a cord and the positions where cord exits are formed in a drum retainer. The present invention is not dependent on a structure that permits or restricts rotation of the drum for winding the cord or the structure of the dial and thus can be applied to and embodied in a winding device and its drum of an article including any of the cord winding structures disclosed in patent documents 1 to 30.

The present invention may be modified without departing from the scope of the invention by changing the order for inserting the cord through the cord insertion holes or by changing the material, dimensions, angle, set position, size, and number of each part in the cord, the cord winding device, and article including the cord winding device.

For example, a drum may include only two cord insertion holes, and the ends of a cord may be fixed by screws or an adhesive agent. Alternatively, a drum may include seven or more cord insertion holes, and those corresponding to the positions of the cord exits may be selected for the insertion of the cord ends.

In the drum 400 of the further embodiment of the present invention shown in the lower right side of FIG. 7, the winding portion 41 may include twelve cord insertion holes 45 and the ends of the cord (shoelace 2) may be inserted through suitable ones of the cord insertion holes 45 to connect and fix the cord to the winding portion 41 of the drum 400.

INDUSTRIAL APPLICABILITY

The present invention has industrial applicability as an article including a cord winding device having superior durability, operability, and maintenance characteristics.

DESCRIPTION OF THE REFERENCE CHARACTERS

1) cord winding device
2) shoelace (cord)
3) base member
31) flange
32) peripheral wall
33) drum retainer
34) rotation shaft
35) cord exit
36) claw
36*a*) spring portion
4) drum
40) drum (other embodiment)
400) drum (other embodiment)
41) winding portion
42) rotation shaft portion
43) recess
44) engagement projection
45) cord insertion hole
46) upwardly-directed teeth
5) dial
51) downwardly-directed teeth
52) shaft hole
53) annular gear
54) spring accommodation portion
55) engagement portion
6) shaft member
62) flange
63) screw insertion hole
7) spring member
71) pin (one end)
72) other end
8) screw
9) cover member
9*a*) through hole
100) body
101) protector (article)
102) holding implement (article)
103) clothing (article)
104) cap (article)
P) connecting-fixing portion
R) arrow (state in which cord is drawn out by full extent from cord winding device)
S) shoe (article)
W) arrow (state in which cord is wound by cord winding device)

The invention claimed is:

1. An article including a cord winding device, comprising:
a cord;
a cord winding device that allows the cord to be tightened and loosened;
a drum including a winding portion around which the cord is wound;
a drum retainer that accommodates the drum in a rotatable manner; and
two cord exits formed in a peripheral wall of the drum retainer to guide the cord from an inner surface of the peripheral wall out of the cord winding device,
wherein when positions where the two cord exits are formed and a center of the drum retainer are not located on a single straight line, even if the cord is rewound by a full extent and drawn out from one of the cord exits when the cord is loosened, fatigue that would be caused by kinks reversing a winding direction of the cord or repetitive bending of the cord does not occur at a connecting-fixing portion of the cord and the winding portion corresponding to the other one of the cord exits,
wherein an angle $\alpha$ by which two connecting-fixing positions, from where the cord is drawn out from the winding portion, are separated is less than 180 degrees to correspond with the positions where the two cord exits are formed,
wherein an angle difference ($\alpha-\beta$) of the angle $\alpha$ by which the two connecting-fixing positions, from where the cord is drawn out from the winding portion, are separated and angle $\beta$ by which the two cord exits are separated in an inner surface of the peripheral wall is included in a range of 0 degrees to 45 degrees.

2. The article including a winding device according to claim 1, wherein by changing an order for inserting the cord through cord insertion hole groups, each including three cord insertion holes, located at point-symmetric positions in the winding portion of the drum, even if the cord is rewound by the full extent and drawn out from one of the cord exits when the cord is loosened, fatigue that would be caused by kinks reversing a winding direction of the cord or repetitive bending of the cord does not occur at the connecting-fixing portion of the cord and the winding portion corresponding to the other one of the cord exits.

3. The article including a winding device according to claim 1, wherein by inserting the cord through cord insertion hole groups, each including three cord insertion holes, formed avoiding point-symmetric positions in the winding portion of the drum, even if the cord is rewound by the full extent and drawn out from one of the cord exits when the cord is loosened, fatigue that would be caused by kinks reversing a winding direction of the cord or repetitive bending of the cord does not occur at the connecting-fixing portion of the cord and the winding portion corresponding to the other one of the cord exits.

4. The article including a winding device according to claim 1, wherein
angle $\alpha$ by which the two connecting-fixing positions, from where the cord is drawn out from the winding portion, are separated is included in a range of 60 degrees to 170 degrees,
angle $\beta$ by which the two cord exits are separated in an inner surface of the peripheral wall is included in a range of 60 degrees to 125 degrees, and
angle $\alpha$ is not smaller than angle $\beta$.

5. The article including a winding device according to claim wherein
angle $\alpha$ by which the two connecting-fixing positions, from where the cord is drawn out from the winding portion, are separated is included in a range of 70 degrees to 125 degrees, and
angle $\beta$ by which the two cord exits are separated in the inner surface of the peripheral wall is included in a range of 70 degrees to 90 degrees.

* * * * *